US005485692A

United States Patent [19]

Seely, III

[11] Patent Number: 5,485,692

[45] Date of Patent: Jan. 23, 1996

[54] MULTIPLE YEAR CALENDAR

[76] Inventor: Douglas D. Seely, III, 69159 Pine Rd., North Liberty, Ind. 46554

[21] Appl. No.: 179,624

[22] Filed: Jan. 10, 1994

[51] Int. Cl.[6] ..... G09D 3/06

[52] U.S. Cl. ..... 40/114; 40/111

[58] Field of Search ..... 40/111, 114

[56] References Cited

U.S. PATENT DOCUMENTS 2,544,148 3/1951 Flanagan ..... 40/111

FOREIGN PATENT DOCUMENTS 439255 6/1912 France ..... 40/114

*Primary Examiner*—Kenneth J. Dorner
*Assistant Examiner*—Cassandra Davis
*Attorney, Agent, or Firm*—Baker & Daniels

[57] ABSTRACT

A multiple year calendar device in which the year indicators of the calendar are locatable references and the days of multiple weeks are listed in chronologically sequential form for each such year indicator. Each of a year's twelve months and the numbered days thereof are registerable with a particular and singular listing of chronologically sequential days of weeks for a year indicator so as to provide for any specific numbered day of the month, the day of the week which such day occurs for the particular year desired. Such a calendar device to accomplish the aforementioned procedure may include one or more rotatable indexes, having on at least one of the indexes, the twelve months of the year and the numbered days thereof.

7 Claims, 5 Drawing Sheets

JANUARY
FEBRUARY 30
32
36
34
44
42
JANUARY
2000 S S T T 6 * S M T W T F S S M T W T F S S M T W T F S

CALENDAR & CYCLE YEARS

| | | | | | | | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|
| 2000 | 05 | 11 | 16* | 22 | S | M | T | W | T | F | S | S | M | T | W | T | F | S | S | M | T | W | T | F | S | M | T | W | T | F | S | S | M | T | W | T | F | S | S | M |
| 2000 * | 06 | 12 | 17 | 23 | M | T | W | T | F | S | S | M | T | W | T | F | S | S | M | T | W | T | F | S | M | M | T | W | T | F | S | S | M | T | W | T | F | S | S | M | T |
| 01 | 07 | 12* | 18 | 24 | T | W | T | F | S | S | M | T | W | T | F | S | S | M | T | W | T | F | S | S | T | T | W | T | F | S | S | M | T | W | T | F | S | S | M | T | W |
| 02 | 08 | 13 | 19 | 24* | W | T | F | S | S | M | T | W | T | F | S | S | M | T | W | T | F | S | S | M | W | W | T | F | S | S | M | T | W | T | F | S | S | M | T | W | T |
| 03 | 08* | 14 | 20 | 25 | T | F | S | S | M | T | W | T | F | S | S | M | T | W | T | F | S | S | M | T | T | T | F | S | S | M | T | W | T | F | S | S | M | T | W | T | F |
| 04 | 09 | 15 | 20* | 26 | F | S | S | M | T | W | T | F | S | S | M | T | W | T | F | S | S | M | T | W | F | F | S | S | M | T | W | T | F | S | S | M | T | W | T | F | S |
| 04* | 10 | 16 | 21 | 27 | S | S | M | T | W | T | F | S | S | M | T | W | T | F | S | S | M | T | W | T | S | S | S | M | T | W | T | F | S | S | M | T | W | T | F | S | S |

| | | | | | | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|
| JANUARY | | | | | | | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | | | | |
| FEBRUARY | | | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29* | | | | | | | | | | |
| MARCH | | | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | | | | | | | | |
| APRIL | | | | | | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | | | | | | |
| MAY | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | | | | | | | | | | |
| JUNE | | | | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | | | | | | | | |
| JULY | | | | | | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | | | | | |
| AUGUST | | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | | | | | | | | | |
| SEPTEMBER | | | | | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | | | | | | | |
| OCTOBER | | | | | | | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | | | | |
| NOVEMBER | | | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | | | | | | | | | |
| DECEMBER | | | | | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | | | | | | |

Fig. 6

QUICK REFERENCE - 28 YEAR REPEATING CYCLE

CALENDAR YEARS

| CYCLE YEAR # | | | | | | |
|---|---|---|---|---|---|---|
| 0 * | 1944 | 1972 | 2000 | 2028 | 2056 | 2084 |
| 1 | 1945 | 1973 | 2001 | 2029 | 2057 | 2085 |
| 2 | 1946 | 1974 | 2002 | 2030 | 2058 | 2086 |
| 3 | 1947 | 1975 | 2003 | 2031 | 2059 | 2087 |
| 4 * | 1948 | 1976 | 2004 | 2032 | 2060 | 2088 |
| 5 | 1949 | 1977 | 2005 | 2033 | 2061 | 2089 |
| 6 | 1950 | 1978 | 2006 | 2034 | 2062 | 2090 |
| 7 | 1951 | 1979 | 2007 | 2035 | 2063 | 2091 |
| 8 * | 1952 | 1980 | 2008 | 2036 | 2064 | 2092 |
| 9 | 1953 | 1981 | 2009 | 2037 | 2065 | 2093 |
| 10 | 1954 | 1982 | 2010 | 2038 | 2066 | 2094 |
| 11 | 1955 | 1983 | 2011 | 2039 | 2067 | 2095 |
| 12 * | 1956 | 1984 | 2012 | 2040 | 2068 | 2096 |
| 13 | 1957 | 1985 | 2013 | 2041 | 2069 | 2097 |
| 14 | 1958 | 1986 | 2014 | 2042 | 2070 | 2098 |
| 15 | 1959 | 1987 | 2015 | 2043 | 2071 | 2099 |
| 16 | 1960 | 1988 | 2016 | 2044 | 2072 | 2100 |
| 17 | 1961 | 1989 | 2017 | 2045 | 2073 | 2101 |
| 18 | 1962 | 1990 | 2018 | 2046 | 2074 | 2102 |
| 19 | 1963 | 1991 | 2019 | 2047 | 2075 | 2103 |
| 20 * | 1964 | 1992 | 2020 | 2048 | 2076 | 2104 |
| 21 | 1965 | 1993 | 2021 | 2049 | 2077 | 2105 |
| 22 | 1966 | 1994 | 2022 | 2050 | 2078 | 2106 |
| 23 | 1967 | 1995 | 2023 | 2051 | 2079 | 2107 |
| 24 * | 1968 | 1996 | 2024 | 2052 | 2080 | 2108 |
| 25 | 1969 | 1997 | 2025 | 2053 | 2081 | 2109 |
| 26 | 1970 | 1998 | 2026 | 2054 | 2082 | 2110 |
| 27 | 1971 | 1999 | 2027 | 2055 | 2083 | 2111 |

* DENOTE LEAP YEARS

TO DETERMINE ANY YEARS THAT IS NOT LISTED USE THE FOLLOWING: SELECT ANY FUTURE YEAR AND SUBTRACT 2000, THEN DIVIDE BY 28, THE REMAINDER EQUALS THE CYCLE YEAR.

EXAMPLE: FUTURE YEAR: 2975
SUBTRACT 2000 -2000
975

DIVIDE BY 28 975/28 = 34 TIMES WITH 23/28THS.
REMAINDER OF 23 = 23RD. CYCLE YEAR

EXAMPLE: YEAR IN PAST: 1994
SUBTRACT 2000 -2000
-6

DIVIDE BY 28 -6/28 = 0 TIMES WITH -6/28THS.
FOR HISTORICAL DATES SUBTRACT: 28-6 = 22
CYCLE YEAR - #22

Fig. 7

MULTIPLE YEAR CALENDAR

SUMMARY OF THE INVENTION

This invention relates to a multiple year calendar and will have particular application to a calendar which is of economical construction and of rapid and simplified use.

Calendars have been known to exist at least as early as 2000 B.C. From such calendars evolved the so called modern day calendars of 365 (366 days for each leap year) year days and 7 day weeks. Multiple year, called "perpetual," calendars are available but heretofore have been of rather complicated usage. Normally such calendars provide the user with information as to only a specific date or single day of the year in a manner which is sometimes at best confusing in use. Usually modern calendars show the relationship between two variables, mainly the days of the week and the year involved. On the calendar the location of the days of the week remains fixed for a constant reference with the months of a particular year and the numbered days thereof being locatable relative to the days of the week reference.

In the following described calendar device of this invention, the reference for the numbered day of each month remain fixed for all years while the days of the week for a particular year are sequentially indexed. In this manner for any particular numbered day of a chosen month, the user of the calendar device may immediately find a corresponding aligned referral to a particular day of the week for the selected year of reference. This determination, that is the alignment of the particular day of a month with the day of the week of a particular year, may be accomplished in a simple and rapid manner by the utilization of a cylindrical rotatable index by which a particular month and the numbered days thereof may be individually referenced and aligned with an adjacent chronological and sequential listing of the days of multiple weeks for a particular chosen year. The years of usage for the calendar device may be expanded to any reasonable number of years, leap years included, by providing a second cylindrical rotatable index having listed thereon by year the chronological and sequential days of the weeks so as to allow the referencing of the year containing index with the month and numbered day containing index to produce the desired visual correlation between the day of the week for a particular year with a particular month and numbered date thereof.

Accordingly, it is the object of this invention to provide a multiple year calendar device which is of simple operation and of easy understanding.

Another object of this invention is to provide a multiple year calendar device which is of economical construction, allowing rapid and accurate use.

Other objects of this invention will become apparent upon reading the following description.

BRIEF DESCRIPTION OF THE DRAWINGS

The following described embodiments of this invention have been chosen for purposes of illustration and description wherein:

FIG. 6 is a planar layout of the months and years indexes for the 28-year calendar illustrated in FIG. 4.

FIG. 7 is a 28 year reference chart.

DESCRIPTION OF THE PREFERRED EMBODIMENTS

The preferred embodiments illustrated are not intended to be exhausting or limit the invention to the precise forms disclosed. They are chosen and described in order to best explain the principle of the invention and its application and practical use.

Figures 1, 2, 3:
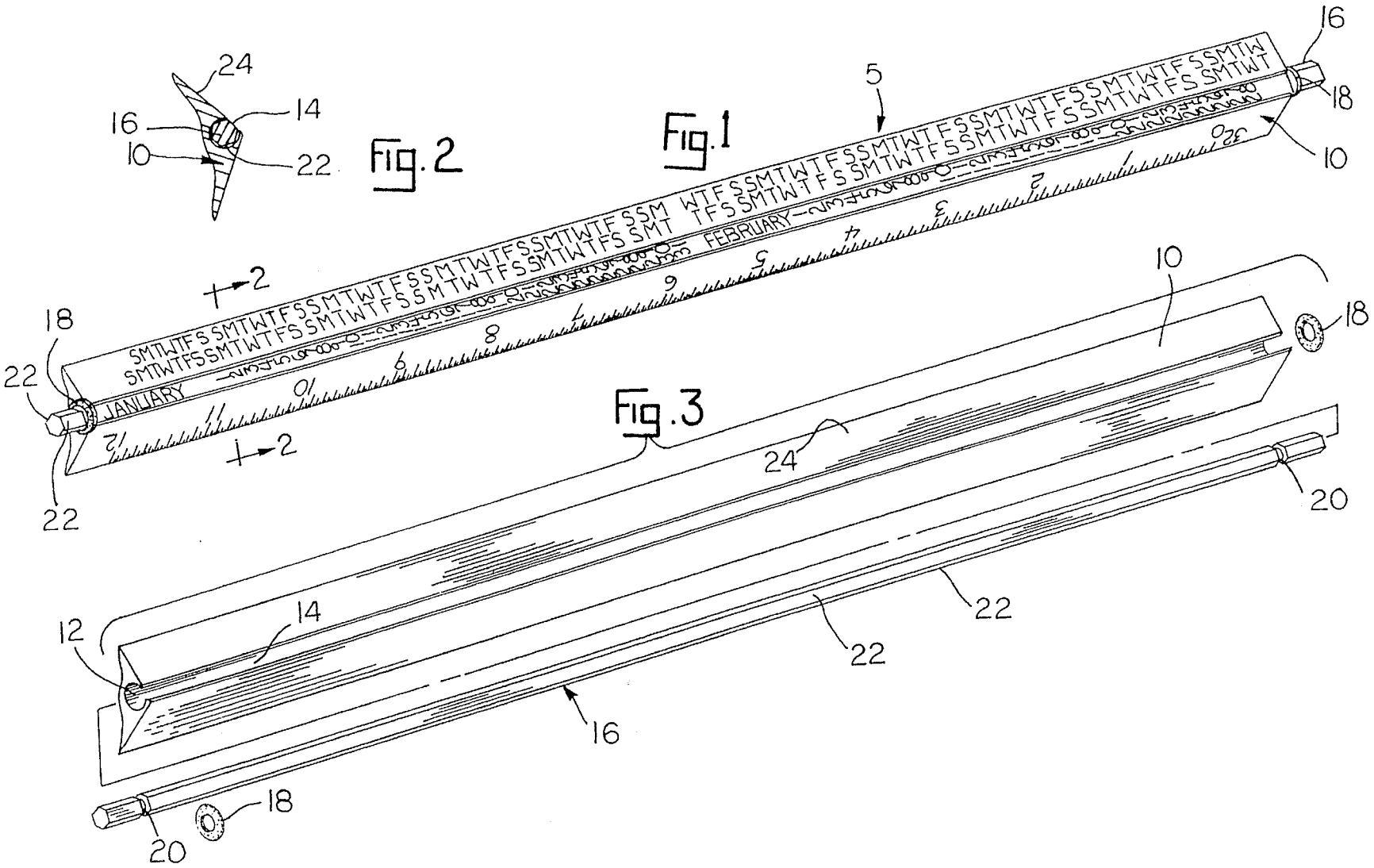
FIG. 1 is a perspective view of one embodiment of the calendar devise of this invention having a two year usage.
FIG. 2 is a cross sectional view of the calendar taken along line 2—2 of FIG. 1.
FIG. 3 is an exploded view showing the parts of the calendar device in FIG. 1 in separated form.

In FIG. 1 a two year calendar device 5 is shown in use in conjunction with a ruler. The general configuration of the ruler is depicted in U.S. Design Pat. No. D267,552. The ruler includes a body 10 having a longitudinally extending cylindrical groove 12 which is open to the top of the rule by an elongated slotted opening 14 which extends the length of the body 10. A cylindrical-like rod 16 fits rotatedly within groove 12 and is retained in the groove by elastic rings 18. Rings 18 fit within grooves 20 at each end of the rod 16 and are seated against the end faces of body 10 so as to prevent the axial removal of the rod from groove 12 but yet will permit rotation of the rod relative to body 10. Rod 16 is of a multiple sided configuration having six sides 22 with the rod being rotatable or indexed so as to locate a particular side 22 within groove slot 14 by which the side may be viewed exteriorly of body 10.

Surface 24 of body 10 which extends along slot 14 into groove 12 contains at its far left end portion, as oriented in the drawings, a listing of two vertically aligned years, in this case 1994 and 1995. Extending longitudinally along body 10 and in alignment with a specific year across surface 24 are four day lists each consisting of a series of chronologically sequential days of multiple weeks, shown abbreviated by reference to the first letter of the particular day. As shown for the year 1994 the first sequential day list begins with a Sunday and ends on a Monday for five weeks and two days and the second day list begins on a Wednesday and ends on a Wednesday for five weeks and one day. In alignment for the year 1995 are two listings of a second series of day lists of chronologically sequential days of multiple weeks with the first list being one day (a Sunday) forwardly offset from the 1994 listing above it and with the second list beginning with a Thursday and ending on a Thursday instead of the Wednesday as the list above it.

Figure 5:
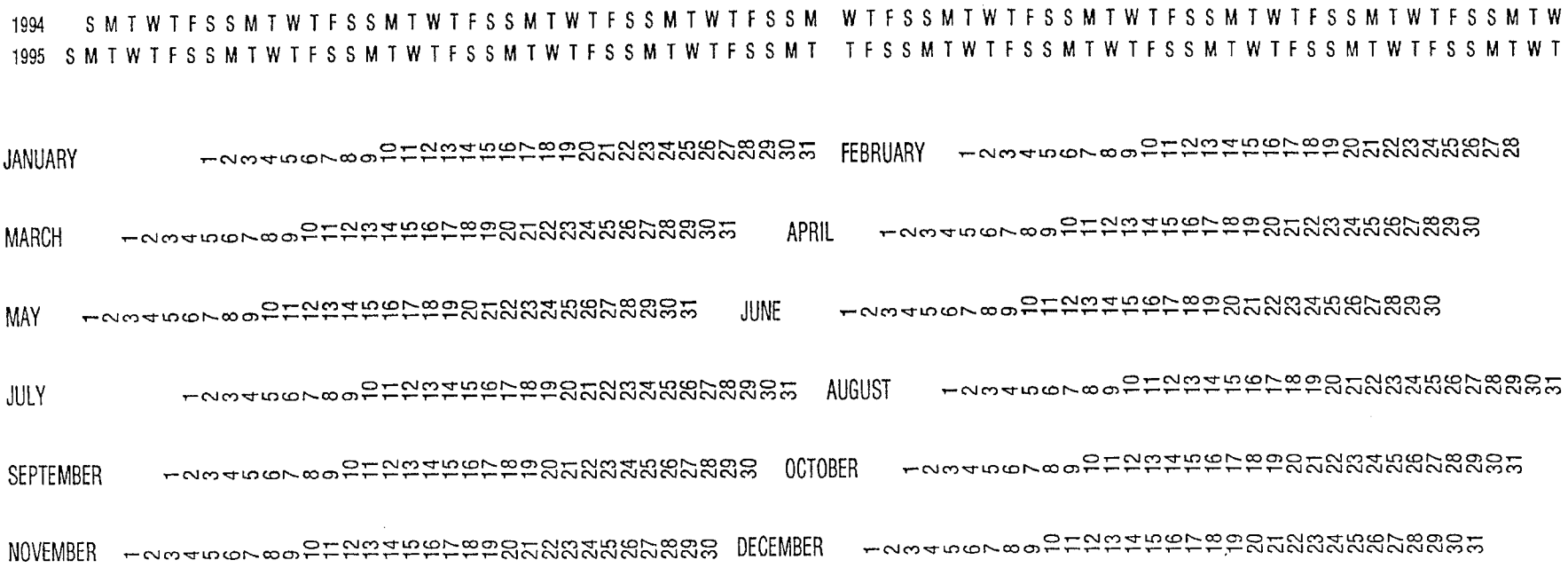
FIG. 5 is a planar layout of the month and year index of the two year calendar illustrated in FIGS. 1–3.

Each month and its respective numbered days are listed or referenced along the longitudinal length of rod 16. Each side 22 of the rod includes two sequential months with each month having following thereafter in a selected space relationship the numbered days of that particular month. FIG. 5 is a planar layout of the index for the months, shown associated with the two years. There are six lines for the twelve months with each line referencing two months. Thus each side 22 of rod 20 will carry in sequential order a pair of months beginning with January and February as illustrated in FIG. 1 and ending on the sixth side with the months of November and December. As one rotates rod 16 relative to body 10, each pair of sequential months will be brought up in chronological order for viewing through slot 14 into groove 12 of body 10. For any particular month thus indexed for viewing, any selected day thereof may be easily visually aligned in vertical orientation with a particular day of a year above it and existing upon surface 24 of body 10. For example, November 8 in the year 1994 will come on a Tuesday, while June 12 in the year 1995 will occur on a Monday.

A twenty eight year cycle is the time necessary for the added leap year date to reoccur on the same day of the week. Normally, in each year a day of the week will advance one day and return to its originally starting day after seven years. However in every fourth year due to leap year, the day of the week will advance one additional day causing the following relationship to advance by two days from the prior year. Thus every four years the dates the numbered days of the week will advance five days to accommodate three years at a one day advancement plus a two day advancement for the leap year. February 29 will not repeat the same day of the week until it has occurred on each of other days of the weeks for example if February 29 starts on a Monday, then the next leap year day will be a Saturday, then a Thursday, then Tuesday, then Sunday, then Friday, then Wednesday, and then on Monday again. Thus leap year will add 7 days to the normal one day advancement for each of the 28 calendar years for a total 35 day advances per 28 year cycle. Accordingly one finds, in FIG. 6, 35 cycle years for the listing to cover the 35 day advances for each 28 year calendar.

The following is a reference table showing the repeating cycle of 28 years for specific calendar years. The figures explain how to determine a cycle year for any specific, past or future, year. This year can be correspondingly located on the calendar and cycle years listing in the table with leap years being split as will be described and the day of any week determined for any numbered day of a specific month.

| Cycle Year # | Quick Reference - 28 Year Repeating Cycle Calendar Years | | | | | |
|---|---|---|---|---|---|---|
| 0* | 1944 | 1972 | 2000 | 2028 | 2056 | 2084 |
| 1 | 1945 | 1973 | 2001 | 2029 | 2057 | 2085 |
| 2 | 1946 | 1974 | 2002 | 2030 | 2058 | 2086 |
| 3 | 1947 | 1975 | 2003 | 2031 | 2059 | 2087 |
| 4* | 1948 | 1976 | 2004 | 2032 | 2060 | 2088 |
| 5 | 1949 | 1977 | 2005 | 2033 | 2061 | 2089 |
| 6 | 1950 | 1978 | 2006 | 2034 | 2062 | 2090 |
| 7 | 1951 | 1979 | 2007 | 2035 | 2063 | 2091 |
| 8* | 1952 | 1980 | 2008 | 2036 | 2064 | 2092 |
| 9 | 1953 | 1981 | 2009 | 2037 | 2065 | 2093 |
| 10 | 1954 | 1982 | 2010 | 2038 | 2066 | 2094 |
| 11 | 1955 | 1983 | 2011 | 2039 | 2067 | 2095 |
| 12* | 1956 | 1984 | 2012 | 2040 | 2068 | 2096 |
| 13 | 1957 | 1985 | 2013 | 2041 | 2069 | 2097 |
| 14 | 1958 | 1986 | 2014 | 2042 | 2070 | 2098 |
| 15 | 1959 | 1987 | 2015 | 2043 | 2071 | 2099 |
| 16* | 1960 | 1988 | 2016 | 2044 | 2072 | 2100 |
| 17 | 1961 | 1989 | 2017 | 2045 | 2073 | 2101 |
| 18 | 1962 | 1990 | 2018 | 2046 | 2074 | 2102 |
| 19 | 1963 | 1991 | 2019 | 2047 | 2075 | 2103 |
| 20* | 1964 | 1992 | 2020 | 2048 | 2076 | 2104 |
| 21 | 1965 | 1993 | 2021 | 2049 | 2077 | 2105 |
| 22 | 1966 | 1994 | 2022 | 2050 | 2078 | 2106 |
| 23 | 1967 | 1995 | 2023 | 2051 | 2079 | 2107 |
| 24* | 1968 | 1996 | 2024 | 2052 | 2080 | 2108 |
| 25 | 1969 | 1997 | 2025 | 2053 | 2081 | 2109 |
| 26 | 1970 | 1998 | 2026 | 2054 | 2082 | 2110 |
| 27 | 1971 | 1999 | 2027 | 2055 | 2083 | 2111 |

To determine any years that is not listed use the following:
Select any future year and subtract 2000, then divide by 28, the remainder equals the cycle year.

Example: Future Year: 2975
Subtract 2000 −2000

975

-continued

| Cycle Year # | Quick Reference - 28 Year Repeating Cycle Calendar Years |
|---|---|
| | Divide by 28 973/28 = 34 times with 23/28th |
| | REMAINDER OF 23 = 23RD. CYCLE YEAR |
| Example: | Year in Past: 1994 |
| | Subtract 2000 −2000 |
| | −6 |
| | Divide by 28 −6/28 = 0 times with −6/28ths. |
| | FOR HISTORICAL DATES SUBTRACT: |
| | 28 − 6 = 22 |
| | CYCLE YEAR = #22 |

*Denotes Leap Years

Figure 4:
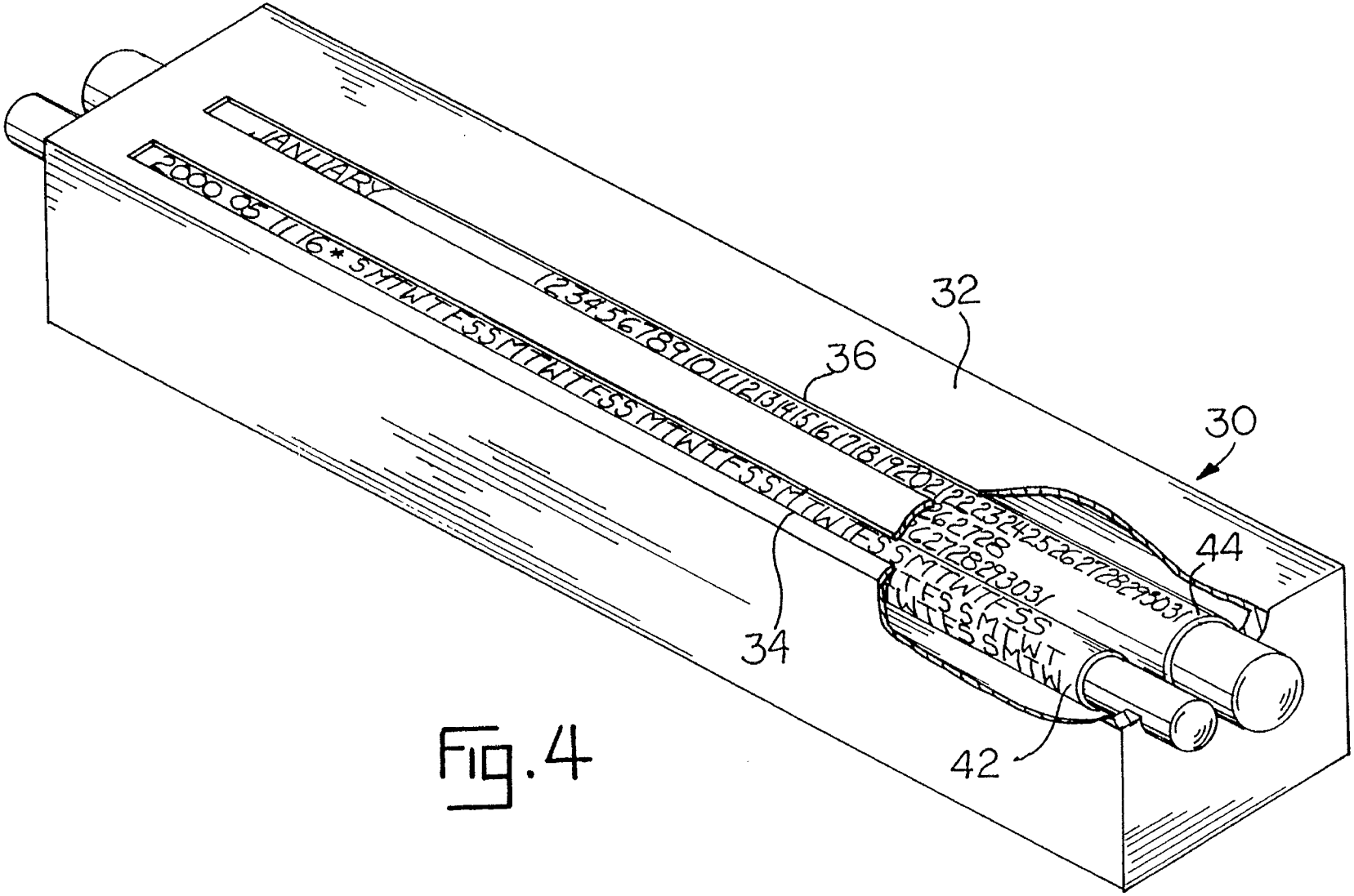
FIG. 4 is a perspective view of another embodiment of the calendar device of this invention illustrating a 28-year calendar.

In FIG. 4 there is shown an embodiment of a perpetual calendar having the capability of providing date correlations for any number of years. In the illustrated embodiment we have shown in the calendar as accommodating twenty-eight years. This calendar device 30 includes a body 32 having two parallel grooves 34 and 36. Grooves 34 and 36 are open to the exterior of body 32 through slots 38 and 40 respectively. A cylindrical rod 42 is rotatably fitted in within groove 34 and a cylindrical rod 44 is rotatably fitted within groove 36. Each of the rods 42, 44 have indicia printed thereon viewable as individual indexes through slots 38 and 40. Rod 42 includes the years and multiple chronologically sequential days of the weeks, while rod 44 has imprinted thereon about its outer surface the twelve months and the numbered days of each of the months. Thus the information on rod 42 corresponds, in general information, to the years and days of weeks imprinted upon surface 24 of body 10 of device.5 and the information upon rod 44 corresponds, in general information, to the month and numbered days found upon sides 22 of rod 20 used in device 5.

In FIG. 6 a planar layout of the data or indexes contained upon rods 42, 44 of device 30. Extending about the outer surface of rod 42 is the information consisting of the years and days of the week shown at the top portion of the layout of FIG. 6. It will be observed that the years are shown on the layout in vertical columns consisting in each column at least five whole years. There are five columns beginning in the first column with the year 2000 and ending in the year 2004, in the second column with the year 2005 and ending with the year 2010, in the third column with the year 2011 and ending with the year 2016, in the fourth column with the year 2017 and ending with the year 2021, and in the last column with the year 2022 and ending with the year 2027. While the years 2000 to 2027 are specifically listed it should be understood that the number of years can be extended indefinitely. The asterisk year(s) found in each of the columns denotes an advancement to the next row of the sequential listing of the days of weeks effective 1 March for the remainder of the index year and is used to accommodate a leap year. Each of the five columns are aligned across or to the right as viewed in FIG. 6 with a row consisting of a chronologically sequential listing of the days of weeks. Each sequential listing consists of five weeks and a portion of a sixth week across the top row of columns with for example the years 2000, 2005, 2011, 2016 and 2022 beginning with a Sunday and ending with a Monday. The cycle years being listed in seven rows correspond, as it will be observed in the first vertical row of the sequential day of weeks listings, to the seven days of the week beginning with Sunday and ending with Saturday. Therefore about rod 42 will be seven longitudinally extending rows of data beginning with a different day of the week in each of the rows and having correlation with that particular row of specific listed years.

For example, the row of data beginning with the sequential day of weeks listing of Friday includes the years 2004, 2009, 2015, 2020, and 2026. As previously mentioned, each asterisk year, such as year 2020, represents a leap year correction in the listings, effective for that year beginning 1 March. Leap year requires two separate year listings –one from 1 January to 29 February (non-asterisk year) and one from 1 March to 31 December (asterisk year).

About rod 44 is the data referring to the twelve months shown the lower portion of FIG. 4. There are twelve rows of information with each row including all the numbered days of a particular month and with that specific month being so indicated. While the number of years for the calendar may be increased to any desired number or reduced, the vertical relationship and the listing of the sequential days of the weeks and the numbered days of the months will always remain the same both in horizontal orientation as well as vertical orientation. Therefore, if one wished to know the day September 9 of year 2020, one will find September 9 on the lower portion of FIG. 6 and using the vertical column in which day 9 is located follow it upwardly until the horizontal line of sequential days of the weeks corresponds to the year 2020 * (this is a leap year and September 9 follows March 7) and it will be observed that September 9 of the year 2020 will be on a Wednesday. As another example, August 17 of the year 2026 will occur on a Monday as evidenced by finding the 17th in the August row and observing above that number day for the year 2026 in the horizontal line of the days of the weeks, with Monday, the initial M standing for Monday, found directly above the August 17 vertical column.

In using the device 30, each of rods 42, 44 will have the information found in FIG. 6 imprinted or applied about the circumferential surface extending longitudinally along the body 32 of the device. Rotation of each respective rod will present a singular line of longitudinal data viewable through either slot 38 for years and days of the weeks and slot 40 for a month and it's numbered days. In this manner for a particular year and a particular month, the numbered day of the month and the day of the week for that month can be visually aligned transversely across the body of device 30.

The embodiments of the calendar devices aforedescribed may be incorporated in other types of embodiments other than on the rotatable rods so shown. Thus the invention is not to be limited to the details described and may be modified in the scope of the appended claims.

I claim:

1. A calendar comprising first and second indexes each of parallel orientation, said first index placed next to said second index, said first index including a listing of various years of said calendar and multiple rows of chronological sequential days of multiple weeks, said years being in at least one column, each year in each said column being alignable with one of, said rows of chronological sequential days, said second index including a listing of the twelve months of a year and multiple rows of numbered days of each month, said twelve months being in a column, each of the twelve months being alignable with a said row of numbered days, each day of said numbered days in each of said twelve months being alignable with a day in a said row of chronological sequential days so aligned with a said year.

2. The calendar of claim 1 wherein said first and second indexes are in horizontal orientation with one placed above the other, said years of said first index being in at least one vertical column and said twelve months of said second index being in a vertical column, each day of said numbered days of each said twelve months being vertically alignable with a day in a said row of chronological sequential days so aligned with a said year.

3. The calendar of claim 1 wherein said years of said first index being 28 calendar years in number and listed chronologically in five vertical columns of seven cycle years each, with the leap years of said calendar year each having two sequential listings in said vertical columns.

4. The calendar of claim 3 wherein said years in a first of said vertical columns beginning with a leap year and ending in the fifth of said chronological calendar years which is a leap year, the next adjacent or a second of said vertical columns to said first vertical column beginning with the sixth of said chronological calendar years and ending in the eleventh of said chronological calendar years, the next adjacent or a third of said vertical columns to said second vertical column beginning with the twelfth of said chronological calendar years and ending upon February 29 of the seventeenth of said chronological calendar years, the next adjacent or a fourth of said vertical columns to said third vertical column beginning with March 1 of the seventeenth of said chronological calendar years and ending with the twenty-second of said chronological calendar years, the next adjacent or a fifth of said vertical columns to said fourth vertical column beginning with the twenty-third of said chronological calendar years and ending with the twenty-eighth of said chronological calendar years.

5. The calendar of claim 1 and including a housing, a first rod and a parallel second rod both rotably carried within said housing, said one index carried upon said first rod and said other index carried upon said second rod.

6. The calendar of claim 5 wherein said housing has two parallel slots formed therein, each rod positioned under a said slot, each said year and aligned said row of chronological sequential days as carried upon said one index being viewable through one said slot and each month and aligned said row of numbered days as carried upon said other index being viewable through another said slot.

7. The calendar of claim 1 and including a housing having a viewing surface and a slotted groove extending along said viewing surface, said one index placed upon said viewing surface, a rod rotably fitted within said groove, said other index carried upon said rod with each month and aligned said row of numbered days being viewable on said rod adjacent said viewing surface.

* * * * *